US006854690B2

(12) United States Patent
Tabor

(10) Patent No.: US 6,854,690 B2
(45) Date of Patent: Feb. 15, 2005

(54) AIRCRAFT KITE

(76) Inventor: Don Tabor, 556 Florence St., Imperial Beach, CA (US) 91932

( * ) Notice: Subject to any disclaimer, the term of this patent is extended or adjusted under 35 U.S.C. 154(b) by 0 days.

(21) Appl. No.: 10/412,060

(22) Filed: Apr. 11, 2003

(65) Prior Publication Data

US 2003/0192993 A1 Oct. 16, 2003

Related U.S. Application Data

(62) Division of application No. 10/339,200, filed on Jan. 8, 2003, now Pat. No. 6,663,050, which is a division of application No. 10/096,023, filed on Mar. 12, 2002, now Pat. No. 6,598,833.

(60) Provisional application No. 60/275,231, filed on Mar. 21, 2001.

(51) Int. Cl.[7] ..... B64C 31/06

(52) U.S. Cl. ..... 244/154; 244/153 R; 244/153 A

(58) Field of Search ..... 244/153–154

(56) References Cited

U.S. PATENT DOCUMENTS

| | | | | | |
|---|---|---|---|---|---|
| 666,427 | A | | 1/1901 | Lamson | |
| 770,626 | A | | 9/1904 | Bell | |
| 1,546,099 | A | | 7/1925 | Myers | 244/154 |
| 1,666,813 | A | * | 4/1928 | Lee | 244/154 |
| 2,035,730 | A | | 3/1936 | Trevor | 244/22 |
| 2,124,992 | A | | 7/1938 | Wood | 244/154 |
| 2,240,881 | A | | 5/1941 | Brandford | 244/154 |
| 2,386,762 | A | | 10/1945 | Wheelwright | 244/153 |
| 2,537,560 | A | | 1/1951 | Wanner | 244/153 |
| 2,539,357 | A | | 1/1951 | Wald | 244/87 |
| 2,744,701 | A | | 5/1956 | Robey | 244/153 |
| 2,801,063 | A | | 7/1957 | O'Gorman | 244/154 |
| 2,827,252 | A | | 3/1958 | Pohl | 244/154 |
| 2,941,765 | A | | 6/1960 | Feldman | 244/153 |
| 3,001,747 | A | | 9/1961 | Hockett | 244/154 |
| 3,018,075 | A | | 1/1962 | Bowers | 244/153 |
| 3,039,722 | A | | 6/1962 | Eustis | 244/153 |
| 3,076,626 | A | | 2/1963 | Andrews | 244/154 |

(List continued on next page.)

OTHER PUBLICATIONS

KITES by Ron Moulton (Excerpts from Book, 67 pages).

KITES (New Edition) by Ron Moulton and Pat Lloyd (Excerpts from Book, 87 pages).

*Primary Examiner*—Michael J. Carone
*Assistant Examiner*—L. Semunegus
(74) *Attorney, Agent, or Firm*—Louis J. Bachand

(57) ABSTRACT

A kite in the shape of an aircraft having one or more wings. The number of wings can vary due to novel V-shaped connection members employed together with strut rod members cut to predetermined lengths. The connection members are preformed V-shaped connectors slidably mounted to spar members disposed in open-ended sleeves in the leading and trailing edges of a wing and may be oriented to receive strut members form either above or below the wing, for efficiency manufacturing, ease in assembly, and minimum exposure to breakage during operation, storage and transport. Additional connection members may be added to the spar members to receive strut members connected to additional wings thereby allowing for an airplane kite having one wing, two wings, three wings, or more. Multiple-V connectors may be combined to create hubs for propellers or wheels that rotate when they encounter a front wind. Ram air openings are utilized in the fuselage of the kite to maintain the shape of the fuselage and the angles of wings. Additionally, the wings are equipped with air scoop pockets for added stability and performance under a large spectrum of flying conditions and improved appearance of the wings without requiring spars along the out edges of the wings. Similar ram air openings or air scoop pockets are utilized in the tail fin members for increased stability and flight characteristics, the tail fins receiving air from either within the fuselage or from outside the fuselage, respectively.

22 Claims, 10 Drawing Sheets

U.S. PATENT DOCUMENTS

| | | | | | |
|---|---|---|---|---|---|
| 3,092,359 | A | | 6/1963 | Pohl | 244/154 |
| 3,093,634 | A | | 6/1963 | Pohl | 244/154 |
| 3,098,634 | A | | 7/1963 | Finklea | 244/153 |
| 3,276,730 | A | | 10/1966 | Cleveland | 244/153 |
| 3,305,198 | A | | 2/1967 | Sellers, Jr. | 244/153 |
| 3,326,392 | A | | 6/1967 | Rock | 244/153 R |
| 3,327,975 | A | | 6/1967 | Vaughan | 244/153 |
| 3,412,964 | A | | 11/1968 | Johnson | 244/153 |
| 3,468,503 | A | | 9/1969 | Snibbe | 244/153 |
| 3,494,578 | A | | 2/1970 | Cureton | 244/153 |
| 3,758,057 | A | | 9/1973 | Stratton | 244/154 |
| 3,801,052 | A | * | 4/1974 | Quercetti | 244/153 R |
| 3,935,664 | A | | 2/1976 | Neuhierl | 46/76 |
| 3,936,020 | A | * | 2/1976 | Jackson | 244/153 R |
| 3,937,426 | A | * | 2/1976 | Pearce | 244/153 R |
| 3,948,471 | A | * | 4/1976 | Pearce et al. | 244/153 R |
| 4,076,189 | A | | 2/1978 | Powell | 244/153 |
| 4,168,816 | A | | 9/1979 | Acosta | 244/154 |
| 4,198,019 | A | | 4/1980 | Linczmajer | 244/123 |
| 4,272,912 | A | | 6/1981 | Lapierre | 46/79 |
| 4,742,977 | A | | 5/1988 | Crowell | |
| 4,807,832 | A | | 2/1989 | Tabor | 244/153 |
| 4,813,637 | A | | 3/1989 | Bondestam | 244/153 |
| 4,815,681 | A | | 3/1989 | Crowell | 244/153 |
| 4,830,313 | A | | 5/1989 | Cheng | 244/153 |
| 4,915,665 | A | | 4/1990 | Ming | 446/66 |
| 5,098,039 | A | | 3/1992 | Linden, Jr. | 244/153 |
| 5,127,611 | A | | 7/1992 | Payne et al. | 244/153 |
| 5,152,481 | A | | 10/1992 | Cote et al. | 244/153 |
| 5,328,134 | A | | 7/1994 | Powers | 244/155 |
| 5,492,288 | A | | 2/1996 | Bordelon | 244/155 |
| 5,556,057 | A | | 9/1996 | Davies | |
| 5,573,208 | A | | 11/1996 | Cassagnes | 244/153 |
| D393,294 | S | | 4/1998 | Crosbie | D21/88 |
| D393,295 | S | | 4/1998 | Crosbie | D21/84 |
| 5,833,174 | A | * | 11/1998 | Knight et al. | 244/155 A |
| D407,126 | S | | 3/1999 | Wang | D21/445 |
| 5,893,537 | A | * | 4/1999 | Lee | 244/153 R |
| 6,003,816 | A | | 12/1999 | Lee | 244/153 |
| 6,062,510 | A | * | 5/2000 | De La Melena | 244/153 R |
| D428,071 | S | | 7/2000 | Wang | D21/453 |
| D428,072 | S | | 7/2000 | Wang | D21/453 |
| D428,451 | S | | 7/2000 | Wang | D21/453 |
| D432,187 | S | | 10/2000 | Wang | D21/445 |
| D443,902 | S | | 6/2001 | Wang | D21/453 |
| 6,290,178 | B1 | | 9/2001 | Wang | 244/153 |
| 6,290,179 | B1 | | 9/2001 | Kerns | 244/154 |
| 6,315,246 | B1 | | 11/2001 | Wu et al. | 244/153 |

* cited by examiner

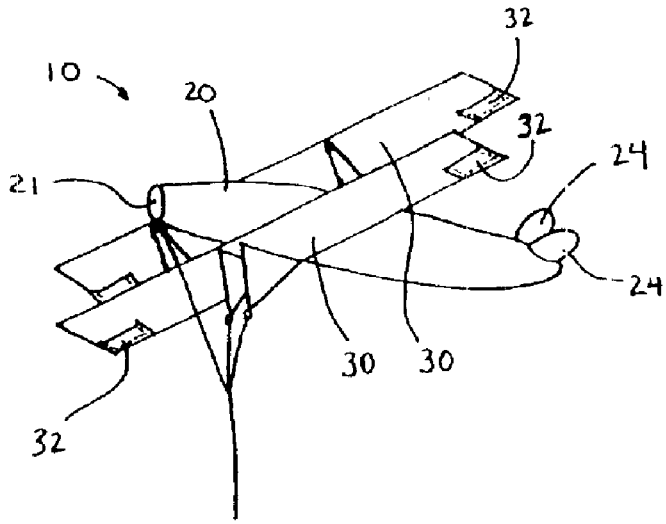
FIG. 1
FIG. 2
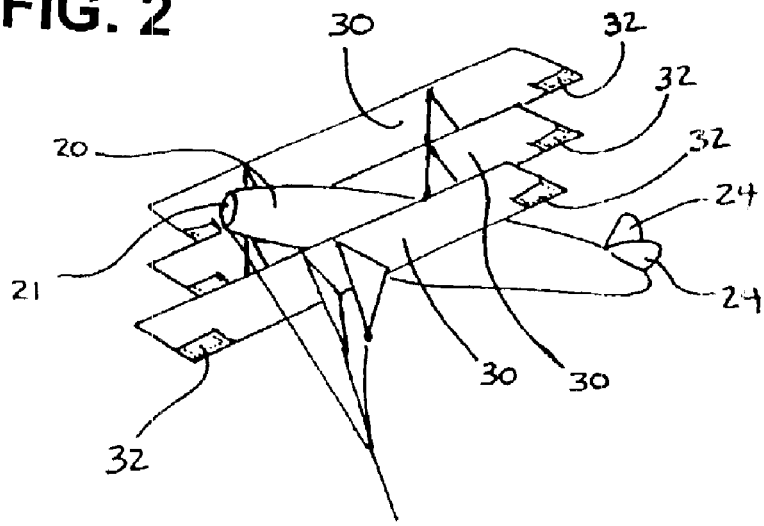

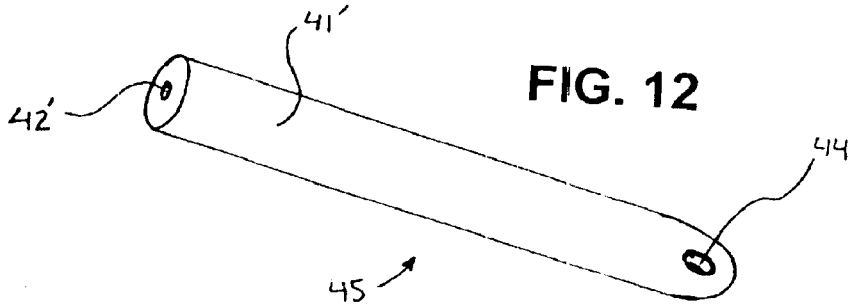
FIG. 12
FIG. 14b
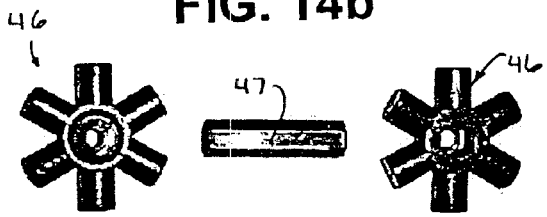
FIG. 14a FIG. 14c
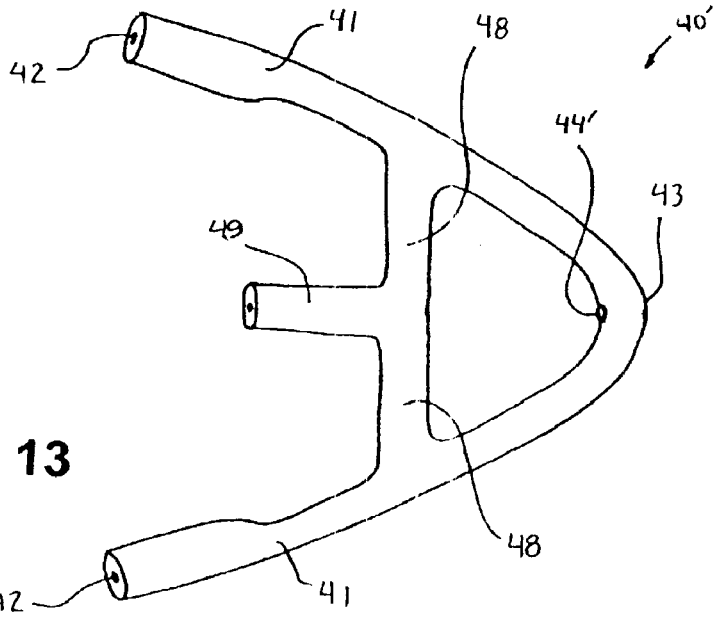
FIG. 13

AIRCRAFT KITE

CROSS-REFERENCE TO RELATED APPLICATIONS

This patent application is a divisional application to U.S. patent application Ser. No. 10/339,200 filed Jan. 8, 2003, now U.S. Pat. No. 6,663,050 and which is a divisional application to U.S. patent application Ser. No. 10/096,023 filed Mar. 12, 2002, now U.S. Pat. No. 6,598,833 and which is related to U.S. Provisional Patent Application Ser. No. 60/275,231 filed Mar. 21, 2001, now abandoned. These applications are incorporated by this reference as if fully set forth herein.

BACKGROUND OF THE INVENTION

This invention relates to a kite in the shape of an aircraft, such as an airplane, and more particularly, aircraft kites in which assembly is made simple, storage and shipping is made simple, and flying is made simple.

Aircraft kites such as kites in the shape of airplanes, space craft, and fanciful flying animals have been made by others. However, there are substantial disadvantages to making aircraft kites that physically look like a true vintage Sopwith Camel and Fokker-era single winged, bi-winged, or tri-winged airplanes, with their rectangular-shaped wings. In order to maintain the wings' shape in flight, previous approaches included lining both the leading and outer edges of the wing with spars made of rigid material such as wooden, plastic or metal rods or tubes. Another approach included extensive use of struts and braces.

These approaches are unsatisfactory because of the excessive number of parts required for assembly and the resulting difficulty of assembly. Since both the leading edge and outer edge are reinforced using a spar, the wing cannot be rolled up when being stored or shipped. Thus, once assembled, such a kite, with its numerous rigid struts and spars, would be vulnerable to being damaged during shipment, on the sale room floor, or when it is transported to the desired flight location. What is needed is a way to reduce the number of rigid parts and still ensure that the wing would maintain its rectangular shape in flight for maximum enjoyment of the kite. In particular, removal of the outer edge wing spar and as many fuselage rods and spars as possible is desirable for storage and shipping considerations.

Still another approach involved foregoing the rectangular shape and using a straight leading edge supported by a spar, but only a curved trailing edge so that in flight the wind force would be sufficient to maintain the shape of the wing. This is also unsatisfactory since the aforementioned vintage planes had rectangular wings. Kite wings that have curved trailing edges, therefore, do not appear like these vintage planes during flight.

Similarly, other aircraft kites such as fanciful space craft and animal kites have suffered from the need for an excessive number of rods, struts, and spars to maintain the unique shape during flight. What was needed was a method for minimizing the number of rods and struts so as to minimize the amount of space that is required to maximize the enjoyment of the operator when transporting, assembling, flying, and disassembling such a kite.

Additionally, the aforementioned aircraft kites generally have a degree of instability that is unpleasant and discouraging to novice and veteran kite fliers alike. What is needed is a method for increasing stability and performance of these kites in flight in order to improve the chances of a pleasant kite-flying experience by the operator under a large spectrum of wind conditions.

Also, most or all mono-winged, bi-winged, and tri-winged aircraft kites are limited to their particular configuration. What was needed was a way to allow the operator to choose the number of wings to attach to the kite depending on either the particular flight conditions or simply the particular flying experience desired by the operator on that day. Additionally, such wing modularization would reduce the costs of manufacturing such winged aircraft kites.

SUMMARY OF THE INVENTION

In one embodiment, the invention involves a kite in the shape of an aircraft, including forms such as an airplane, flying animals, cartoon figures, or other fanciful aircraft having one or more wings and an improved configuration and method for the assembling and disassembling the kite. The ease of assembly and disassembly is created by the extensive and repeated use of preformed connectors in the shape of a "V", an "I", a nose cone, or a four- or six-arm intersection, depending on the intended use of the connector.

Also due to the repeated use of these connectors as a stock item in the assembly of an aircraft kite, the number of wings attached to the kite can vary depending on the desires of the operator. That is, the second, third, fourth, and so on, wings may be connected by a series of struts and braces attached to one another through a number of these preformed connector members.

Additionally, in one embodiment, the shape of each wing is maintained in flight with a minimum of struts and spars by using one or more scoops or pockets fixed to the lift surfaces of the wings. During flight, the pockets catch air and thereby reduce fluttering of the wing and force the trailing edge of the wing back. Moreover, the pockets thereby effect the flight characteristics of the wing and greatly improve the stability and performance of the aircraft kite. As a result, the aircraft kite of the present invention has improved stability and performance with respect to earlier aircraft kite designs, and it utilizes less rigid parts making the kite easier to assemble, more convenient to store and ship, and less vulnerable to breakage in transit and during operation.

Stability and performance are further improved by using inflatable tail fin members. As with the wing pockets, the tail fin members catch air during flight through openings at or near the point where the tail fin member is connected to the fuselage portion of the kite. Whether the tail fin members catch air from within the fuselage (as a closed windsock) or from outside the fuselage, the tail fin members greatly add to the stability and flight characteristics of the kite and effect the angle of attack like a real airplane. The stability and performance characteristics are further improved by the use of twin keels connecting the kite to the kite string, providing a 3-point twin keel kite string harness connection.

One objective of this invention is to make an airplane kite having improved stability and performance, and reduce or eliminate independent wing oscillation, by using air scoop pockets in its one or more wings and alternatively in its tail fins. Stability and performance are also improved by utilizing one or more ram air openings for receiving air during flight in an otherwise closed airfoil-shaped fuselage. Another objective of this invention is to make an airplane kite that has a realistic appearance in flight, including having one or more wings that are rectangular. Yet another objective of this invention is to make an airplane kite that can be easily and efficiently manufactured employing relatively few parts, and thereby also easily assembled by even novice operators, disassembled, stored and transported. Another objective is to minimize the number of parts and thereby minimize the exposure to breakage during operation, transport, and storage.

Yet another objective of this invention is to make an airplane kite that may be assembled to have any number of wings still maintaining the ease of assemble and a minimum of manufacturing costs.

These and other objectives and goals will be evident to one of ordinary skill in the art upon the descriptions and disclosures made herein.

BRIEF DESCRIPTION OF THE DRAWINGS

FIG. 1 is a perspective view of one embodiment of the present invention including a bi-wing airplane kite.

FIG. 2 is a perspective view of another embodiment of the present invention including a tri-wing airplane kite.

FIG. 12 is a perspective view of an I-connector in keeping with one embodiment of the present invention.

FIG. 13 is a perspective view of a nose cone connector in keeping with one embodiment of the present invention.

FIG. 14*a* is a top plan view of a multiple-V connector or hex-connector in keeping with one embodiment of the present invention.

FIG. 14*b* is a top plan view of an extender for combining two hex-connectors in keeping with one embodiment of the present invention.

FIG. 14*c* is a bottom plan view of a multiple-V connector or hex-connector showing how two hex connectors may be combined to create a wheel or propeller hub in keeping with one embodiment of the present invention.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. References to an airplane form is meant as illustrative of a preferred embodiment and for convenience of example. Airplane as used herein has been specifically defined above.

For the sake of convenience and clarity, this disclosure makes references throughout to kites having "airplane" forms, and "airplane" is defined for the purposes of this application to mean any aircraft, real or fictional, man-made or natural. Where wings are unnecessary to explain the present invention, the definition includes any such aircraft, whether or not it has wings, such as dirigibles, spacecraft without wings, wingless animals, and the like. The following describes one preferred embodiment, namely an aircraft or airplane kite having one or more wings to emulate the classic propeller biplanes and tri-planes of the World War I era. This invention, however, contemplates kites of other designs, such as depictions of winged animals, spacecraft, fictional crafts, cartoon, and the like.

FIGS. 1 and 2 illustrate a preferred embodiment of the invention, which involves the modular attachment of any number of wings to an airplane-shaped kite 10. The wing members 30 are substantially rectangular in shape to give the airplane a look as close as feasibly possible to a bi-wing or tri-wing airplane of the era of the Fokker and the Sopwith Camel. The fuselage 20 is air foil shaped to enhance flight characteristics. It maintains its shape during flight by receiving air through one or more ram air openings 21 at the front end of the fuselage and having no vent for this air.

Figure 3A:
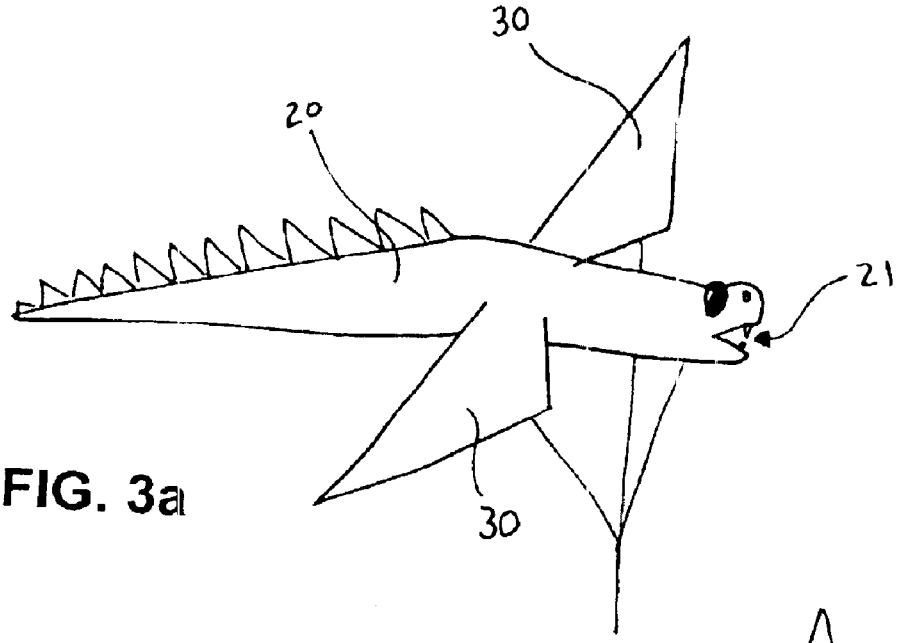
FIG. 3*a* is a perspective view of one embodiment of the present invention including a fanciful dragon-shaped kite.
Figure 3B:
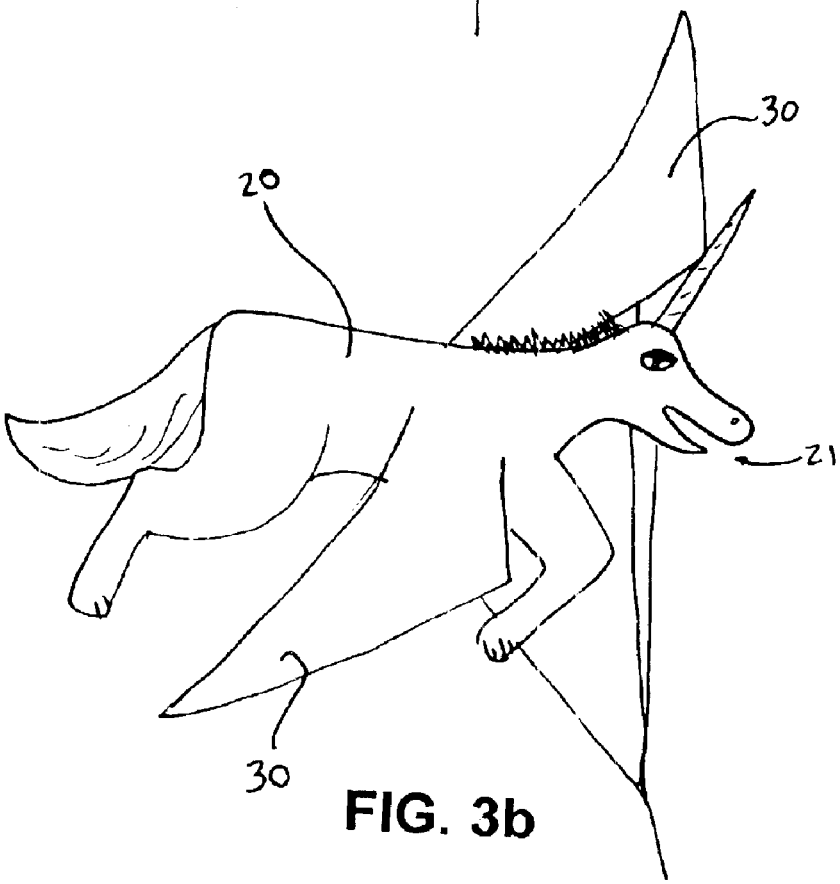
FIG. 3*b* is a perspective view of another embodiment of the present invention including a fanciful unicorn-shaped kite.

FIGS. 3*a* and 3*b* illustrate another preferred embodiment of the present invention, namely that of a fanciful flying animal. The wing members 30 comprise two delta-shaped wings. As a result, the flying efficiency of these animal-shaped aircraft kites is greatly improved over other commercially available kites of having these types of fuselages. By utilizing two delta-shaped wings side-by-side, the fanciful aircraft kites of the present invention enjoy all of the long history of research and development that has gone into the design of such delta-wing kites, including the inventor's own contributions to the field. By specifically combining two delta wings, the fuselage may be made into almost any inefficient body shape, such as an elephant, a pig, a horse, a unicorn, a dragon, etc. All of these body types and more have been applied to the dual-delta wing arrangement with great success in both ease of flight and maneuverability during flight, which greatly improves the customer's kite flying experience, whether he or she is a novice or an expert.

Figure 4A:
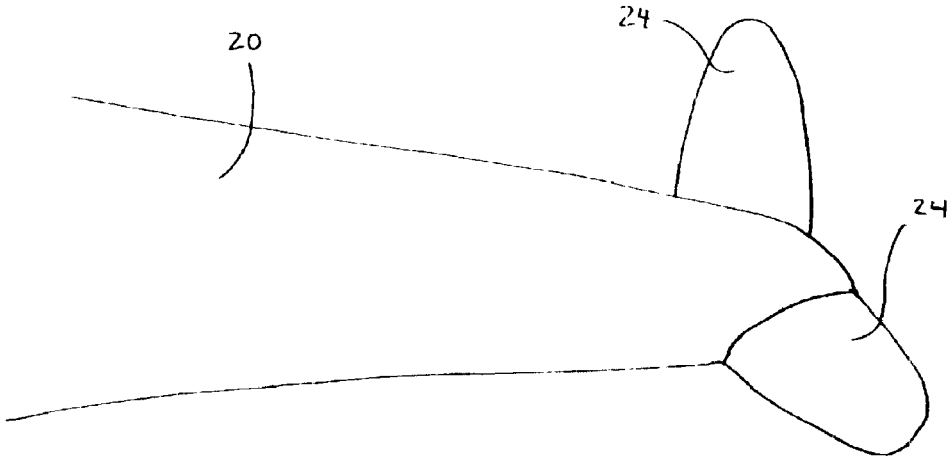
FIG. 4*a* is a side elevation view of the tail end of the fuselage showing inflatable tail fin members as contemplated in one embodiment of the present invention.
Figure 4B:
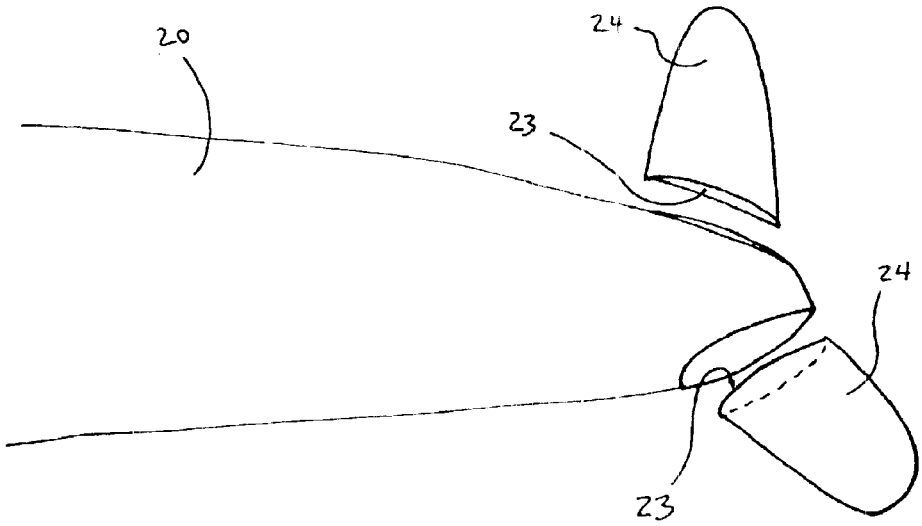
FIG. 4*b* is an exploded side elevation view of the tail end of the fuselage showing inflatable tail fin members.
Figure 5A:
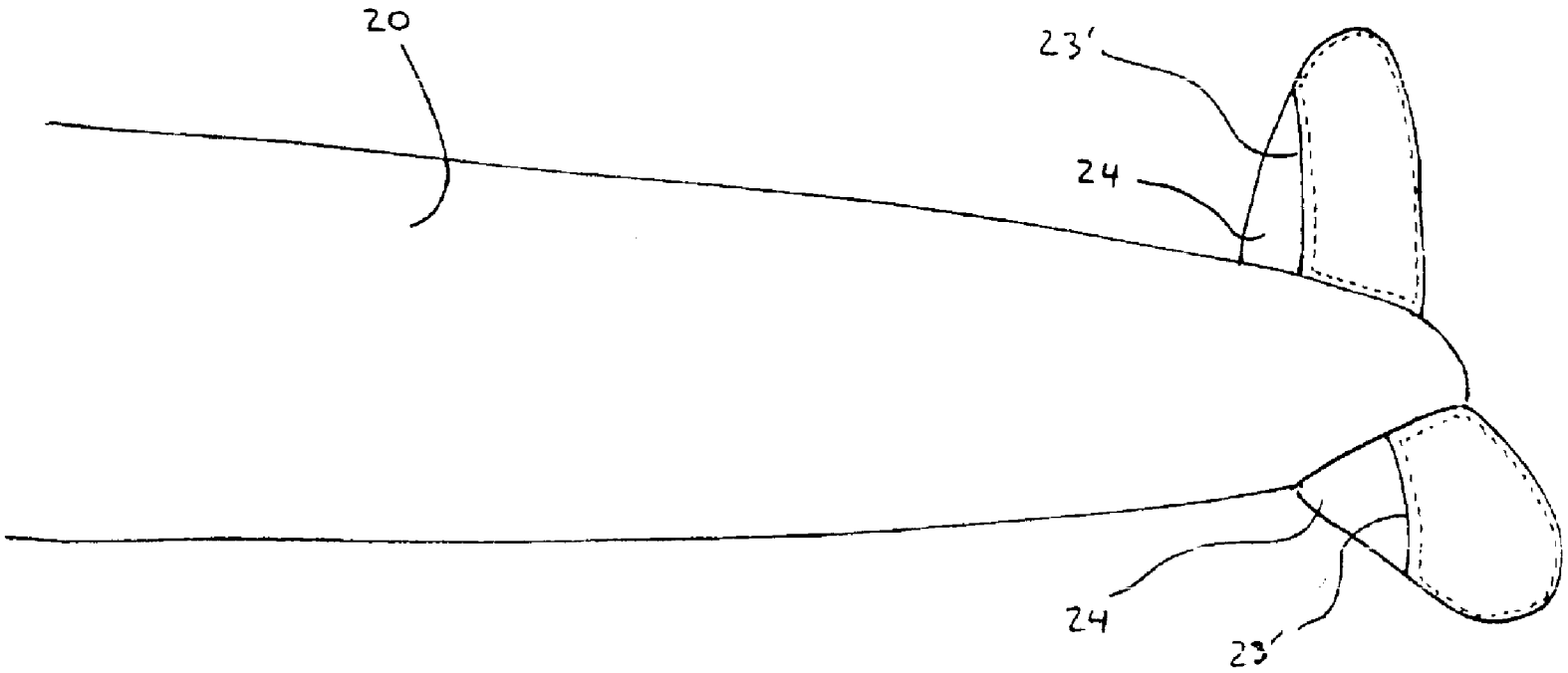
FIG. 5*a* is a side elevation view of the tail end of the fuselage showing tail fin members having air scoop pockets as contemplated in one embodiment of the present invention.
Figure 5B:
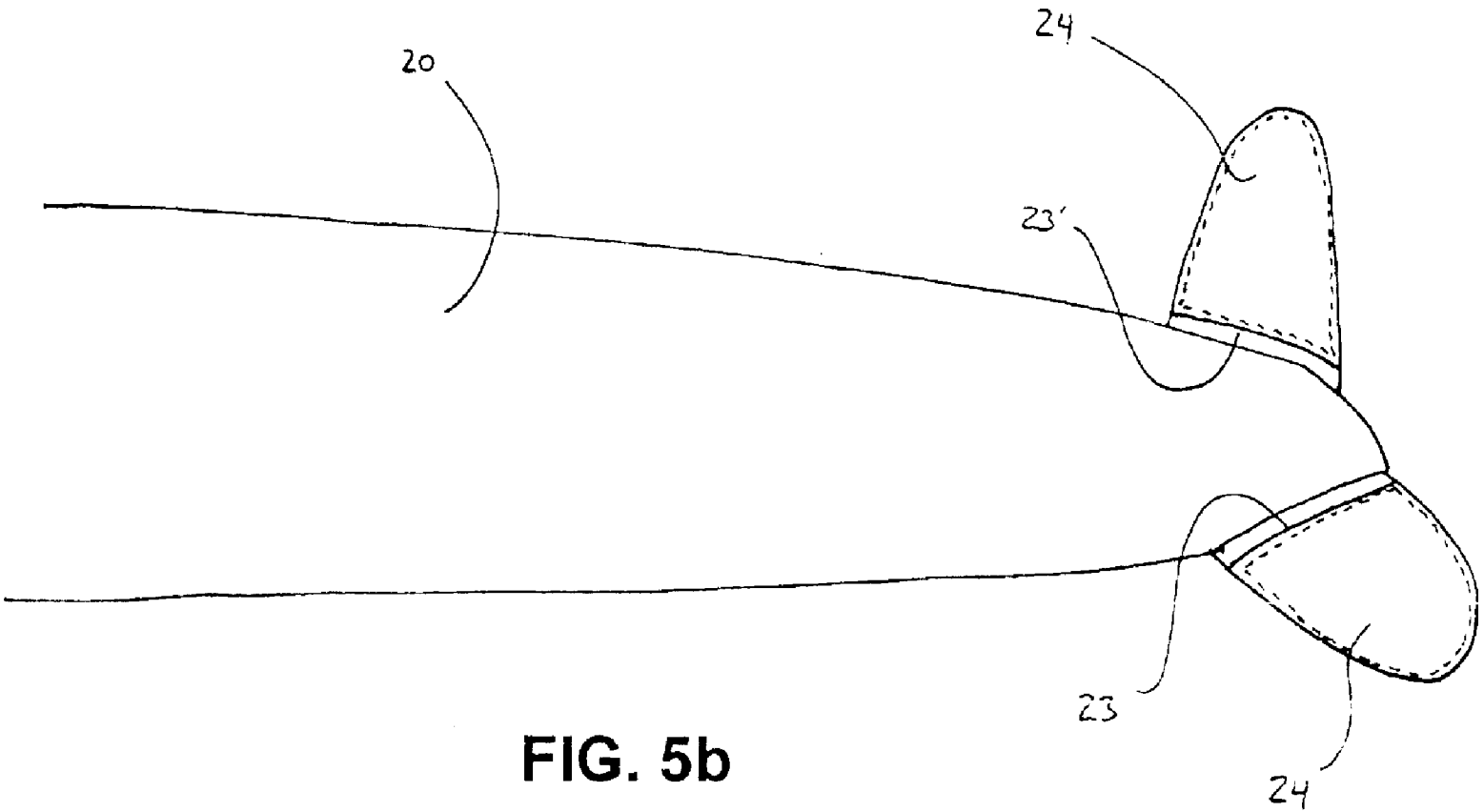
FIG. 5*b* is a side elevation view of the tail end of the fuselage showing tail fin members having air scoop pockets as also contemplated in another embodiment of the present invention.

In either case, the air may be further directed into tail fin members 24 through openings 23 formed by the attachment of the tail members 24 to the fuselage 20. This is shown in FIGS. 4*a* and 4*b*. Alternatively, the tail fin members 24 have air scoop pockets sewn or otherwise fixed to the tail fin members and having openings 23' oriented to receive air from outside of the fuselage. This alternative embodiment is shown in FIGS. 5*a* and 5*b*.

Figure 6:
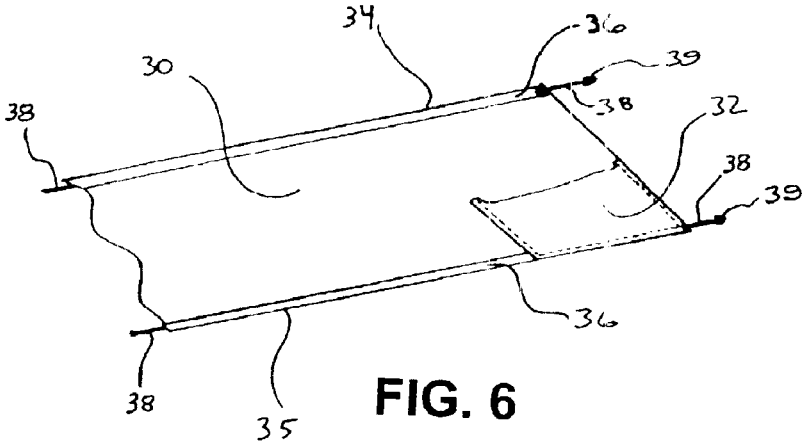
FIG. 6 is a perspective view of the outer end of one wing member showing an air scoop pocket as contemplated in one embodiment of the present invention, with spars 38 extending from hem sleeves 36 in order to illustrate end caps 39.
Figure 7A:
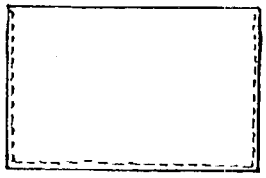
FIGS. 7*a, b,* and *c* are bottom views of a rectangular, semi-circular, and triangular air scoop pocket designs.
Figure 7B:
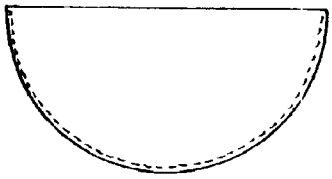
Figure 7C:
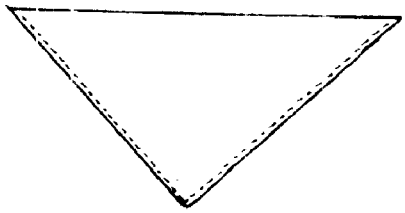

In a preferred embodiment, the wing members also contain air scoop pockets 32, which are oriented to receive air during flight. These air scoop pockets 32 greatly improve the stability and performance of the kite in a wide spectrum of varying wind conditions. In a preferred embodiment, the air scoop pockets are sewn, glued, or otherwise attached to the outer ends of the trailing edges of the wings. Whether or not the pockets 32 are placed at the outer ends of the wing members, the preferred embodiment involves placing the pockets on each wing member equidistant from the center of the fuselage on both sides of the fuselage thereby balancing the lift and drag characteristics created by each pocket 32. Examples of such pockets are shown in FIGS. 6 and 7*a–c*, although the pockets need not be rectangular in shape (FIG. 7*a*), triangular (FIG. 7*b*), or semi-circular (FIG. 7*c*). Rather, the present invention contemplates any number of shapes for such air scoop pockets, including asymmetric or curved air scoops or pockets, as well as preformed non-planar shapes such as spoilers, nozzles, or the like. These and other shapes are anticipated in order to conform to the shape of the wing or surface upon which the pocket in attached and the flight characteristics sought. By customizing the shape of the air scoop or pocket 32 in this way, the wing 30 may obtain a more desirable appearance, either in a show room or in flight, or both.

Additionally, the fuselage 20 itself is designed for improved stability and performance in operation. The fuselage 20 receives air during flight through one or more ram air openings 21, shown as a central circular opening in FIGS. 1 through 3*b*. Unlike most kite designs known to the inventor, the preferred embodiment of the present invention comprises a fanciful or an airfoil-shaped fuselage 20 that has one or more ram air openings 21 for receiving air during flight, but that is otherwise a closed surface. As a result, during flight air is forced into the fuselage of the kite and, unlike other kites available on the market today, remains in the fuselage with little or no path for the air to exit the fuselage, apart from the porosity of the material used and the seams between pieces of such material.

Thus, the ram air effect fills the kite's fuselage causing the fuselage to maintain its airfoil or fanciful shape during flight, and also maintains the wings at the predetermined angles. That is, as a result of this design, the fuselage 20 maintains its shape during flight under a wide spectrum of weather and wind conditions and changing wind patterns, thereby improving the flight dynamics and stability of the kite 10.

The wing members 30 comprise, in addition to the above-mentioned air scoop pockets 32, a wing material, such as nylon fabrics, or other adequate substrates familiar to the kite industry, a leading edge 34 and a trailing edge 35. The leading and trailing edges each have hem sleeves 36, and disposed within each hem sleeve is a rigid rod or spar 38. The ends of the hem sleeves 36 are not sewn up, but rather left open so that the spar 38 can be removed from the sleeve. The spar 38 is kept from sliding around on its own within the hem sleeves 36 by end caps 39 thumb-pressed onto the ends of each spar 38, as shown in FIG. 6.

The end caps 39 provide enough resistance to lateral movement of the spar 38 to keep the spar in place during storage and during flight. The end caps 39, however, do not provide so much resistance that the operator cannot intentionally remove the spar 38 from the hem sleeves 36. Thus, the spars 38 may readily be moved through the hem sleeves 36, and this mobility of the spar 38 also allows the operator to quickly replace a spar 38 in the event that the spar 38 is fractured during transportation or during use. Additionally, due to this mobility of the spar 38, the spar may be made to take on additional V-connectors, I-connectors, or other connectors as described below in order to modify the configuration of the kite 10.

Figure 8:
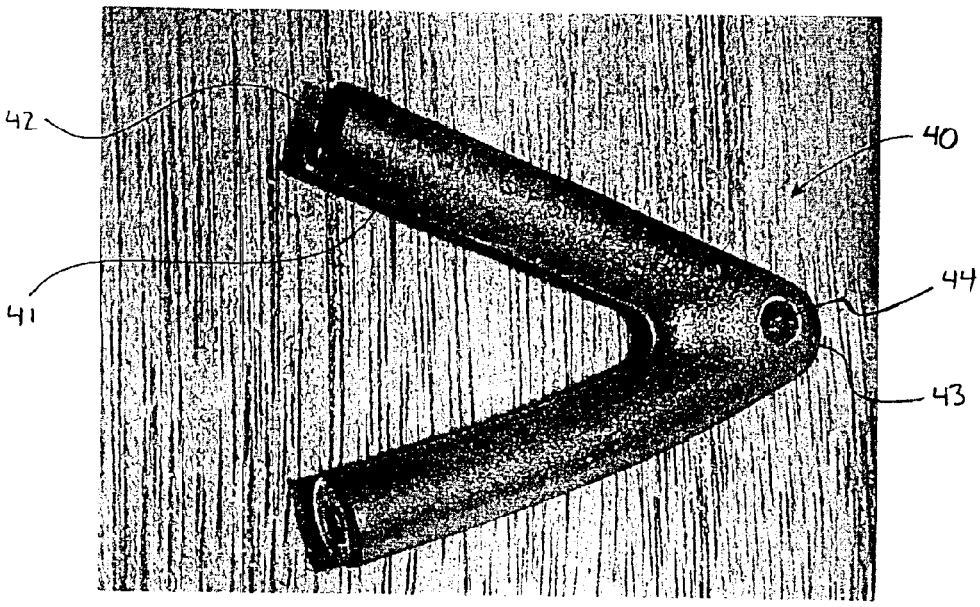
FIG. 8 is a perspective view of a V-connector in accordance with one embodiment of the present invention.

A principal building block of aircraft kites of the present invention is the V-connector 40, as shown in FIG. 8. Extensive use of the V-connector 40 greatly reduces the design constraints when designing a novel aircraft kite. It greatly reduces the costs of manufacturing and the number of pieces required for the manufacture and construction of an aircraft kite, and it greatly simplifies the assembly of the kite by the customer. It also absorbs the majority of the impact of a collision or hard landing during flight. As a result, the V-connector greatly improves the efficiency of providing a novel aircraft kite to a customer, and greatly improves the customer's experience in flying the kite, whether the customer is a novice or familiar with kites, assembling kites, and flying them.

The V-connector 40 is made of an elastomeric material, as is the I-connector 45 and hex-connector 47, so that it may be used under a number of assembly conditions and so that shock is absorbed during flight, landing, and transportation. The V-connector, as shown in FIG. 8, is shaped like a "V" having two legs 41 and an apex or intersection 43. The end of each leg 41 further defines a longitudinal opening 42, and the apex or intersection 43 of the V-connector further defines a lateral orifice 44.

Using this configuration, the V-connector is used in a wide variety of situations in aircraft kite construction. Anytime two or three rods are to intersect, a V-connector may be used to facilitate the intersection. One rod is slid through the lateral orifice 44 and the other one or two rods or spars are inserted into the longitudinal openings 42 of a single V-connector. The intersection of the rods may then be adjusted simply by sliding the V-connector along the first rod or sliding one or both of the latter two rods or spars further in or out of the longitudinal openings 42. That is, the longitudinal openings 42 should be deep enough to permit a sufficient friction fit at a range of lengths of rod. In a presently preferred embodiment, the longitudinal opening 42 is between 0.75 and 1.25 inches deep, while the entire length of each leg 41 is 1.50 inches.

In one application, V-connectors 40 are slidably and rotatably connected to the spars 38 in the hem sleeves 36 of the leading and trailing edges of each wing member 30, by sliding the spar through the lateral orifice 44. In a multiple-winged aircraft kite, the first and last wings have a single set of connector members 40 rotated to face the other wing(s), whereas the intermediate wings each have two sets of connector members 40, one set rotated to face the wing below, the other set rotated to face the wing above. The assembly, then, is completed simply by inserting precut rigid strut members into the longitudinal openings 42 in the ends 41 of the corresponding connector members 40.

The connector members 40 are easily attachable and removable. Thus, the last wing can be easily made into an intermediate wing for the attachment of yet another wing by attaching to it another set of connector members.

Figure 9:
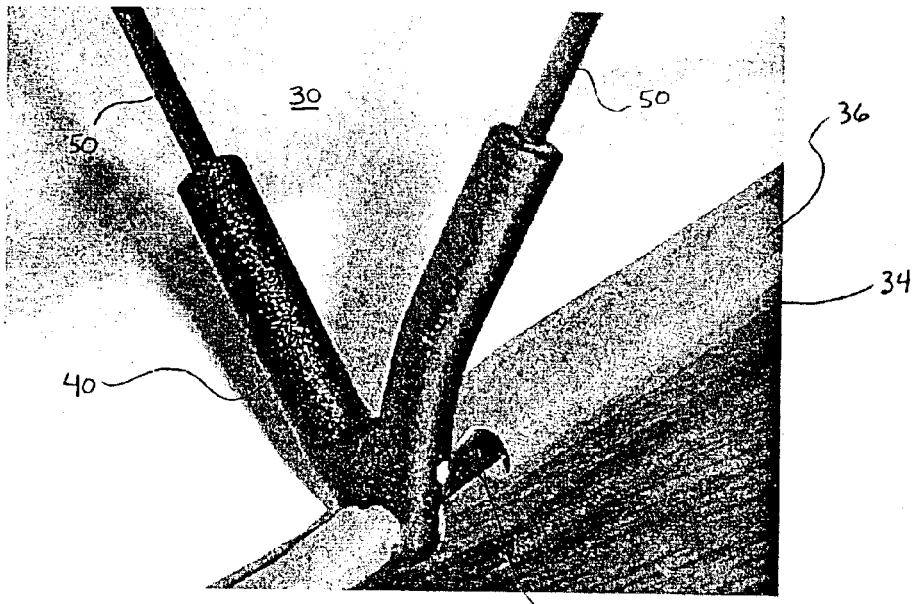
FIG. 9 is a perspective view of a wing spar of a first wing member, a V-shaped connector, and two strut members oriented toward a second wing member.
Figure 10:
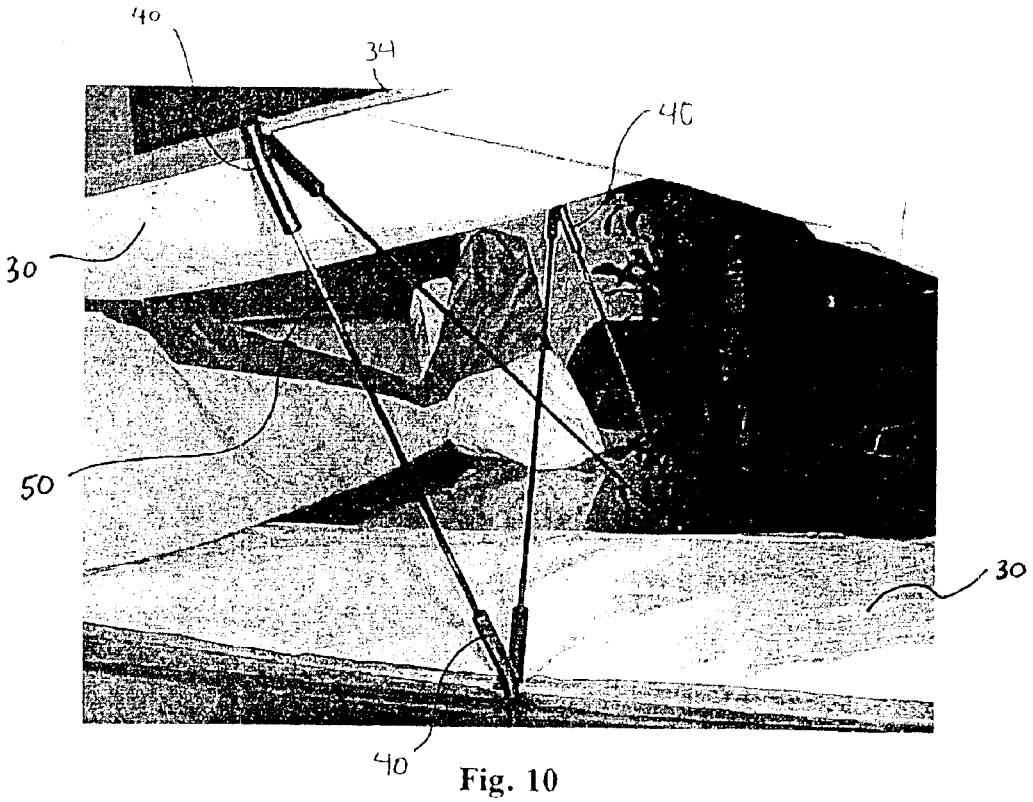
FIG. 10 is a perspective view of two wing members as contemplated in one embodiment of the present invention showing four connector members and four strut members between the respective wing spars.
Figure 11:
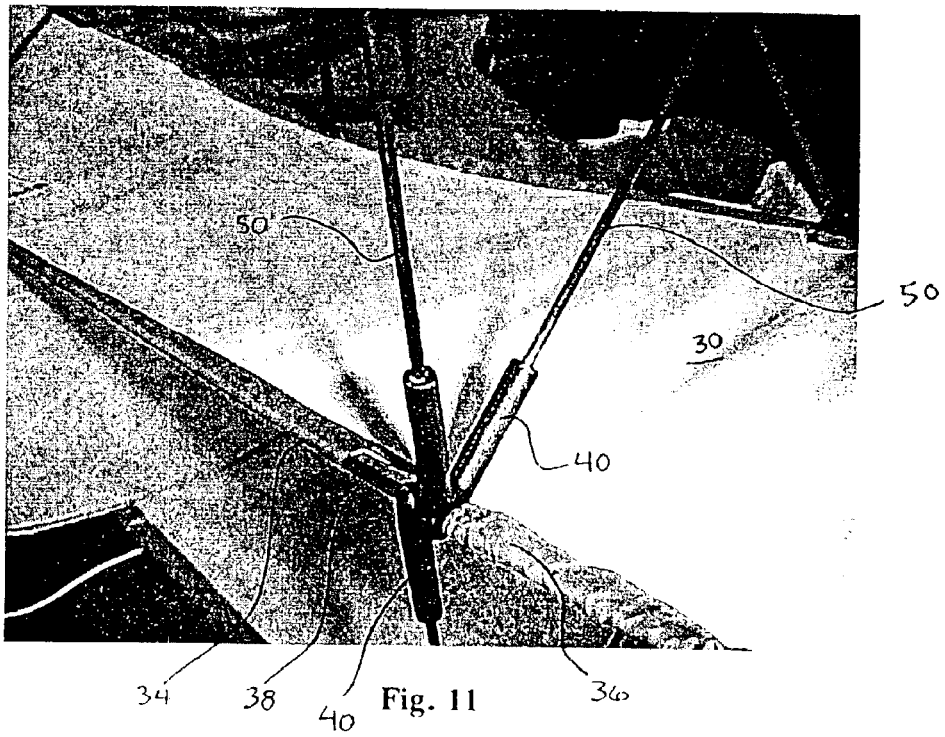
FIG. 11 is a perspective view of a second wing member as contemplated in one embodiment of the present invention showing two V-connections on a wing spar, one oriented toward the first wing member and the other oriented toward the third wing member.

While the foregoing description of the V-connector describes longitudinal openings 42 at each end of each leg of the V shape as well as a lateral orifice 44 through the intersection of the legs, the longitudinal opening 42 could be rather a socket for receiving a ball joint at the end of a strut member or a cylindrical shape for receiving the end of a rod-shaped strut member 50 itself. The strut members 50 may be solid, such as 3.18 mm solid fiberglass rods, as in the preferred embodiment shown in FIGS. 9–11. Alternatively, the present invention contemplates equally that the longitudinal opening may be replaced by a finger end member or a ball joint end member for engagement with the inner surfaces of a hollow end of a strut member.

In a preferred embodiment, these V-shaped connectors 40 are made out of an elastomer, such as rubber for maintaining traction with the strut members 50, and also providing an additional degree of flexibility during transport, flight, and landing. The connectors are an improvement over earlier approaches to the problem of attaching wings to an airplane kite. First when a group of these connectors are disposed along the spars in the leading and trailing edges of the wing members 30, assembly is very easy. One end of a strut member 50 of predetermined length is snuggly inserted into the longitudinal opening of one end of the V-shaped connector and then the other end of the strut member is snuggly inserted into the opening of the corresponding end of the corresponding V-shaped connector 40 in an adjacent wing member 30.

With respect to assembly of a kite having more than a single wing member 30, for the first wing member, there is only one set of V-shaped connectors 40 slidably disposed along each of the spars. These V-connectors are oriented in the direction of the second wing and attachment is begun by snuggly inserting a strut member 50 of appropriate length into each longitudinal opening of this first set of V-shaped connectors 40.

For the second wing member, there are two sets of V-shaped connectors. To continue assembly, one set of these V-shaped connectors is oriented to receive the strut members extending from the set of V-connectors attached to the first wing member. Once the end of each such strut member is snuggly inserted into the corresponding longitudinal opening of the corresponding V-connector attached to the second wing member, the strut framework is established between the first and second wing members.

Assembly is continued by orienting the second set of V-connectors of the second wing member in the direction of the third wing member. The above-mentioned routine is repeated, namely snuggly inserting strut members of the appropriate length into each longitudinal opening of this set of V-shaped connectors.

For third and subsequent wing members, the above-mentioned assembly routine is repeated. Except for the last wing member, each intermediate wing member contains two sets of V-shaped connectors, one set oriented toward the connectors of the previous wing member, the other oriented toward the connectors of the next wing member in the series. The last wing member, like the first wing member is provided with only a single last set of V-shaped connectors. The connectors of this single last set of connectors are oriented toward the connectors of the previous wing member.

In a preferred embodiment, these connector members are preformed in a "V" shape, but they may also be preformed in the shape of an "I", the shape of a four- or six-armed intersection, or the shape of a nose-cone, depending on the application. Fore example, where an aircraft design calls for the intersection of only two rods, one of the rods may be slid through the lateral orifice 44 and the other rod may be slid into one longitudinal opening 42 of one leg 41. In this case, the second longitudinal opening 42 is not needed. As a result, the second leg 41 would constitute unnecessary added weight. Either the customer could cut this second leg 41 off, or preferably the manufacturer could simply supply the customer with a connector member in the shape of an "I", or I-connector 45 with a single leg 41', as shown in FIG. 12.

In another application, the aircraft kite design may call for an intersection of more than three rods. At present, the use of propellers that rotate with respect to the fuselage of the kite are immensely popular and desirable. FIG. 14*a* illustrates a novel configuration of a multiple-V connector 46 that can be used to quickly assemble a propeller or, alternatively, a rotating wheel. This multiple-V connector, or hex-connector 46, may be rotatably mounted to a rod 38 or strut member 50 so that the hex-connector will rotate when it encounters a front wind.

Figure 15A:
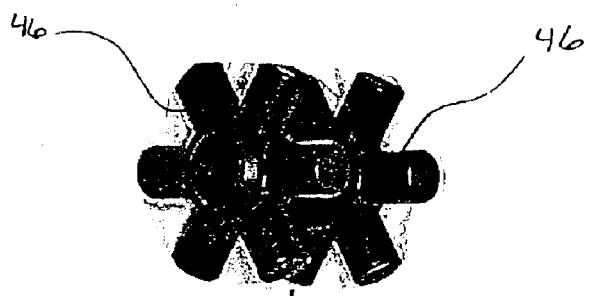
FIG. 15*a* is a perspective view of a multiple-V connector or hex-connector in keeping with one embodiment of the present invention as used to emulate a propeller hub.
Figure 15B:
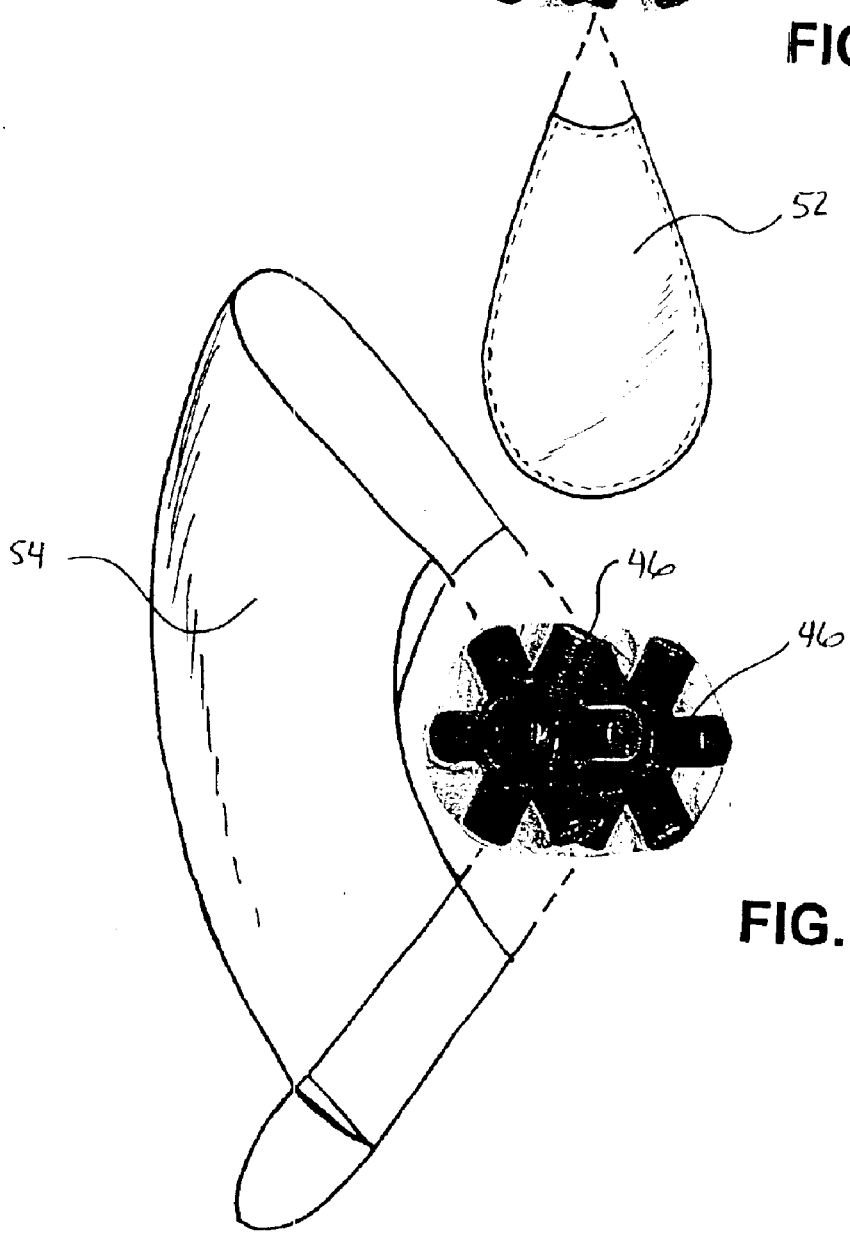
FIG. 15*b* is a perspective view of a multiple-V connector or hex-connector in keeping with one embodiment of the present invention as used to emulate a wheel hub.

Two hex-connectors may be combined using an extender 47 to create a hub for a propeller or for a wheel, as shown in FIGS. 14*b*, 14*c*, and 15*a* and 15*b*. That is, a hub of two hex-connectors separated by an extender may be rotatably mounted to a rod of the kite and be further utilized in conjunction with one, two, three, or up to six specially designed kite propeller blade pieces 52 to create a propeller that will catch wind during flight and rotate relative to the fuselage of the kite, creating a desirable appearance of a functioning propeller or rotor, as shown in FIG. 15*a*. Alternatively, specially made kite wheel pieces 54 could be attached to the hub to create the appearance of a rotating wheel, as shown in FIG. 15*b*.

Likewise, the popular propellers may be placed in front of the fuselage or mock wing engine compartments by the use of a nose cone connector 40', as shown in FIG. 13. The nose cone connector is simply a specially designed V-connector. The legs 41 are extra long so that the propeller may be positioned far in front of the fuselage or engine compartment. Additionally, the lateral orifice 44' and connector apex 43 is oriented to be in the same plane as the longitudinal openings 42 since the rod 38 that is to hold the propeller must extend forward within this mutual plane. With the nose cone connector 40', an additional cross member 48 may be molded between the two legs 41, as shown in FIG. 13, in order to increase the structural rigidity of the connector, and to provide lateral stabilizer 49 to provide an additional degree of support to the rod 38 or strut member 50 that is to hold the propeller in position.

The disclosed embodiment is illustrative of the invention and is not intended to be exhaustive. Other embodiments are contemplated by the present invention as one of ordinary skill in the are would appreciate upon reading the aforementioned disclosure.

What is claimed is:

1. A kite in the form of an aircraft comprising a fuselage, at least one wing member, at least three rods in an arrangement to support said aircraft, and a V-connector comprising an apex extending in an apex plane and first and second legs extending from said apex, said legs extending at least initially in said apex plane, said first and second legs having longitudinal openings to receive respectively first and second ones of said rods in spaced relation to said apex, said apex receiving a third one of said rods transverse to said apex plane to define said aircraft supporting arrangement of said rods.

2. The kite according to claim 1, in which said V-connector comprises an elastomer.

3. The kite according to claim 2, in which said V-connector is flexible to absorb shock during flight, landing and transportation.

4. A kite in the form of an aircraft comprising a fuselage, at least one wing member, and at least one V-connector carried by said fuselage, said V-connector comprising a common apex extending in an apex plane and pairs of legs extending from said common apex symmetrically in a series of V patterns and at least initially in said apex plane, said common apex being slidably mounted to a further rod extending transverse to said apex plane.

5. The kite according to claim 4, in which said V-connector is rotatably mounted on said further rod for rotation as a hub a propeller.

6. The kite according to claim 5, in which said V-connector is a first V-connector, and including also a second V-connector having pairs of pairs of legs extending from said common apex symmetrically in a series of V patterns and at least initially in said apex plane, said second V-connector being mounted also on said further rod and in spaced relation to said first V-connector.

7. The kite according to claim 5, in which said V-connector legs have longitudinal openings adapted to receive propeller blade pieces.

8. The kite according to claim 6, in which at least one of said V-connectors defines a wheel hub.

9. The kite according to claim 4, in which said V-connector comprises an elastomer.

10. A kite in the form of an aircraft comprising a fuselage, at least one wing member, and at least one nose cone connector comprising two legs, an apex, a longitudinal opening at a distal end of each leg, and a lateral orifice through said apex, wherein said lateral orifice is in the same plane as each said longitudinal opening.

11. A kite according to claim 10, further comprising a cross member intermediate and fixed to each leg to reinforce the rigidity of said nose cone connector, and a support member having a support opening extending therethrough, said support member mounted to and perpendicular to said cross member to provide support to a rod when said rod is placed in said lateral orifice and extending through said support opening.

12. The kite according to claim 11, in which said nose cone connector comprises an elastomer and is flexible to absorb shock during flight, landing and transportation.

13. A kite according to claim 10, further comprising a rod placed through said lateral opening, and a hex-connector attached to said rod and used as a hub for a propeller.

14. A connector for a kite construction having first, second and third rods intersecting, said rods each having rod ends and an intermediate portion therebetween, said connector comprising an apex extending in an apex plane and first and second legs, said first and second legs having inner ends extending from said apex and at least initially in said apex plane and outer ends remote from said apex, said apex having an orifice for mounting said apex on said third rod intermediate its rod ends and transverse to said apex plane, said first and second legs ends having longitudinal openings for receiving rod ends respectively of said first and second rods.

15. The kite connector according to claim 14, in which said connector comprises an elastomer.

16. In combination: the kite connector of claim 14, and a kite.

17. The combination according to claim 16, in which said kite comprises an aircraft having a fuselage and multiple wings in spaced, opposed relation, each said wing being supported by a said third rod on which said connector is mounted, said first and second rods being received in said first and second legs of said connector, whereby said wings are maintained in their said spaced opposed relation by said connector.

18. A kite connector for connecting first, second and third rods of a kite construction, said rods having rod ends and an intermediate portion between said rod ends, said connector comprising an apex and outwardly extending first and second legs, said first and second legs having longitudinal openings into which said rod ends are insertable, said apex having an orifice for slidably receiving an intermediate portion of said third rod, said apex orifice extending normal to said longitudinal openings.

19. The kite connector according to claim 18, in which said connector comprises an elastomer.

20. In combination: the connector according to claim 18, and a kite.

21. The combination according to claim 20, in which said kite comprises an aircraft having a fuselage and multiple wings, said wings being in spaced, opposed relation, each said wing being supported by a said third rod on which said connector is mounted, said first and second rods being inserted in said first and second legs of said connector, whereby said wings are maintained in their said spaced opposed relation by said connector.

22. A method of supporting a kite framework comprising three intersecting rods, including placing a connector at the intersection of said rods, said connector having two legs joined at an apex extending in an apex plane, attaching two of said rods longitudinally and endwise at said legs, and attaching a third of said rods laterally and intermediate the rod ends at said apex and at a right angle to said apex plane.

* * * * *